US007137847B2

(12) United States Patent
Trout et al.

(10) Patent No.: US 7,137,847 B2
(45) Date of Patent: Nov. 21, 2006

(54) SLIDE-TO-LATCH PANEL MOUNT CONNECTOR

(75) Inventors: David Allison Trout, Lancaster, PA (US); Daniel Robert Ringler, Elizabethville, PA (US); Richard Nicholas Whyne, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/031,140

(22) Filed: Jan. 7, 2005

(65) Prior Publication Data

US 2006/0154514 A1 Jul. 13, 2006

(51) Int. Cl.
*H01R 13/58* (2006.01)

(52) U.S. Cl. ..... 439/465; 439/545; 439/544; 439/562

(58) Field of Classification Search ..... 439/545, 439/465, 247–248, 557, 552–554, 157, 544, 439/310, 372, 347, 567, 562
See application file for complete search history.

(56) References Cited

U.S. PATENT DOCUMENTS 5,002,497 A * 3/1991 Plocek et al. ..... 439/248
5,127,852 A * 7/1992 Cravens et al. ..... 439/545
5,800,208 A * 9/1998 Ishizuka et al. ..... 439/557
6,095,854 A 8/2000 Sommer et al. ..... 439/545
6,176,738 B1 1/2001 Consoli et al. ..... 439/545
6,312,285 B1 11/2001 Berg et al. ..... 439/545
6,332,789 B1 * 12/2001 Okabe ..... 439/157

* cited by examiner

*Primary Examiner*—Truc T. Nguyen
*Assistant Examiner*—Edwin A. Leon

(57) ABSTRACT

An electrical connector includes a housing having a forward mating end and a rearward contact loading end. The housing includes first and second opposite sides. The housing is configured for insertion into a panel opening that has an inner edge. The housing is inserted into the panel opening in a first direction in an insertion position and is movable within the panel opening in a second direction substantially perpendicular to the first direction from the insertion position to a latched position. A latch member extends from the first side of the housing and has first and second ends attached to first and second opposite ends of the first side of the housing. An arcuate latch beam joins the first and second ends of the latch member, and a latch element positioned on a forward facing surface of the latch beam engages the inner edge of the panel opening to hold the housing in the latched position.

20 Claims, 3 Drawing Sheets

SLIDE-TO-LATCH PANEL MOUNT CONNECTOR

BACKGROUND OF THE INVENTION

The invention relates generally to electrical connectors, and more particularly, to a panel mount connector having a latch mechanism that provides for mounting of the connector without hardware.

In general, an electrical cable includes one or more conductors, which may be wire conductors, that are surrounded by insulation. Networked electronic systems often include a number of devices communicating with other devices through a number of associated electrical cables with electrical connectors. Typically, one device is connected to another device or system through a single conductor or multiple conductors that are terminated with contacts in a connector housing. To terminate the conductors to the connector contacts, wire insulation is removed from an end of the cable to expose the conductors therein. The conductors are placed into the contacts of the connector and the conductors are attached thereto, such as with crimping or soldering techniques.

It is common to utilize a backshell on an electrical connector to protect the conductors of the electrical cable which are connected to the contacts in the connector. The backshell covers the contact tails to prevent someone or something from inadvertently touching the energized contacts. The backshell may also provide strain relief for the cable so that excessive forces applied to the cable will not cause the cable conductors to become disconnected from the contacts in the connector housing.

In at least some electronic systems, the electrical connectors are mounted to a connector panel for mating with a complementary mating connector. The connectors are mounted to the connector panel using a variety of methods such as brackets, clamps, or threaded bolts or other fasteners. With the continuously increasing demand for resources in today's systems, connector space on the connector panels is in short supply. In many instances, due to space limitations, system operators limit the amount of connector space available for each application. In addition to the size of the connectors and backshells themselves, features that may be provided for particular mounting arrangements may also contribute to space shortages on the connector panel by increasing the space required between connectors. For example, U.S. Pat. No. 6,095,854 describes a panel mounting system for a connector that includes a side mounted latch that is enclosed in a protective shroud to protect the latch from breakage. As another example, U.S. Pat. No. 6,312,285 describes a panel mounting system that includes a latch mechanism on the top of the connector that almost doubles the height of the connector.

A need remains for a connector assembly that has a smaller footprint to facilitate saving space on the connector panels. It would be further desirable to provide a connector assembly that is mountable to the panel without the need for tools or mounting hardware.

BRIEF DESCRIPTION OF THE INVENTION

In one aspect, an electrical connector for mounting to a panel is provided. The connector includes a connector housing that has a forward mating end and a rearward contact loading end. The housing includes a first side and a second side opposite the first side. The housing is configured for insertion into an opening in the panel, wherein the opening has an inner edge. The housing is inserted into the panel opening in a first direction in an insertion position and is movable within the panel opening in a second direction substantially perpendicular to the first direction from the insertion position to a latched position. A latch member extends from the first side of the housing in a direction opposite the second direction. The latch member has first and second ends attached at respective first and second opposite ends of the first side of the housing, an arcuate latch beam joining the first and second ends of the latch member, and a latch element positioned on a forward facing surface of the latch beam. The latch element engages the inner edge of the panel opening when the housing is in the latched position to hold the housing in the latched position.

Optionally, the connector further includes a backshell that has a connector receiving end and a cable exit end. The connector housing coupled to the connector receiving end of the backshell. The backshell having an edge at the connector receiving end that engages the panel to limit movement of the housing in the first direction. The backshell includes a cutout at the connector receiving end that receives the latch member. Alternatively, the housing includes a flange formed on a third side of the housing. The flange extends from the housing in a direction substantially perpendicular to the first and second directions. The flange engages the panel to limit movement of the housing in the first direction.

In another aspect, an electrical connector for mounting to a panel is provided. The connector includes a connector housing that has a forward mating end and a rearward contact loading end. The housing includes a first side and a second side opposite the first side. The housing is configured for insertion into an opening in the panel, wherein the opening has an inner edge. The housing is inserted into the panel opening in a first direction in an insertion position and is movable within the panel opening in a second direction substantially perpendicular to the first direction from the insertion position to a latched position. A latch member extends from the first side of the housing in a direction opposite the second direction. The latch member has first and second ends attached at respective first and second opposite ends of the first side of the housing, an arcuate latch beam joining the first and second ends of the latch member, and a latch element positioned on a forward facing surface of the latch beam. The latch element engages the inner edge of the panel opening when the housing is in the latched position to hold the housing in the latched position. A retention tab is formed on a second side of the housing opposite the first side. The retention tab has a length substantially equal to a length of the second side. The retention tab extends from the housing in the second direction. The retention tab engages a forward side of the panel to inhibit extraction of the housing from the panel when the housing is in the latched position.

DETAILED DESCRIPTION OF THE INVENTION

Figure 1:
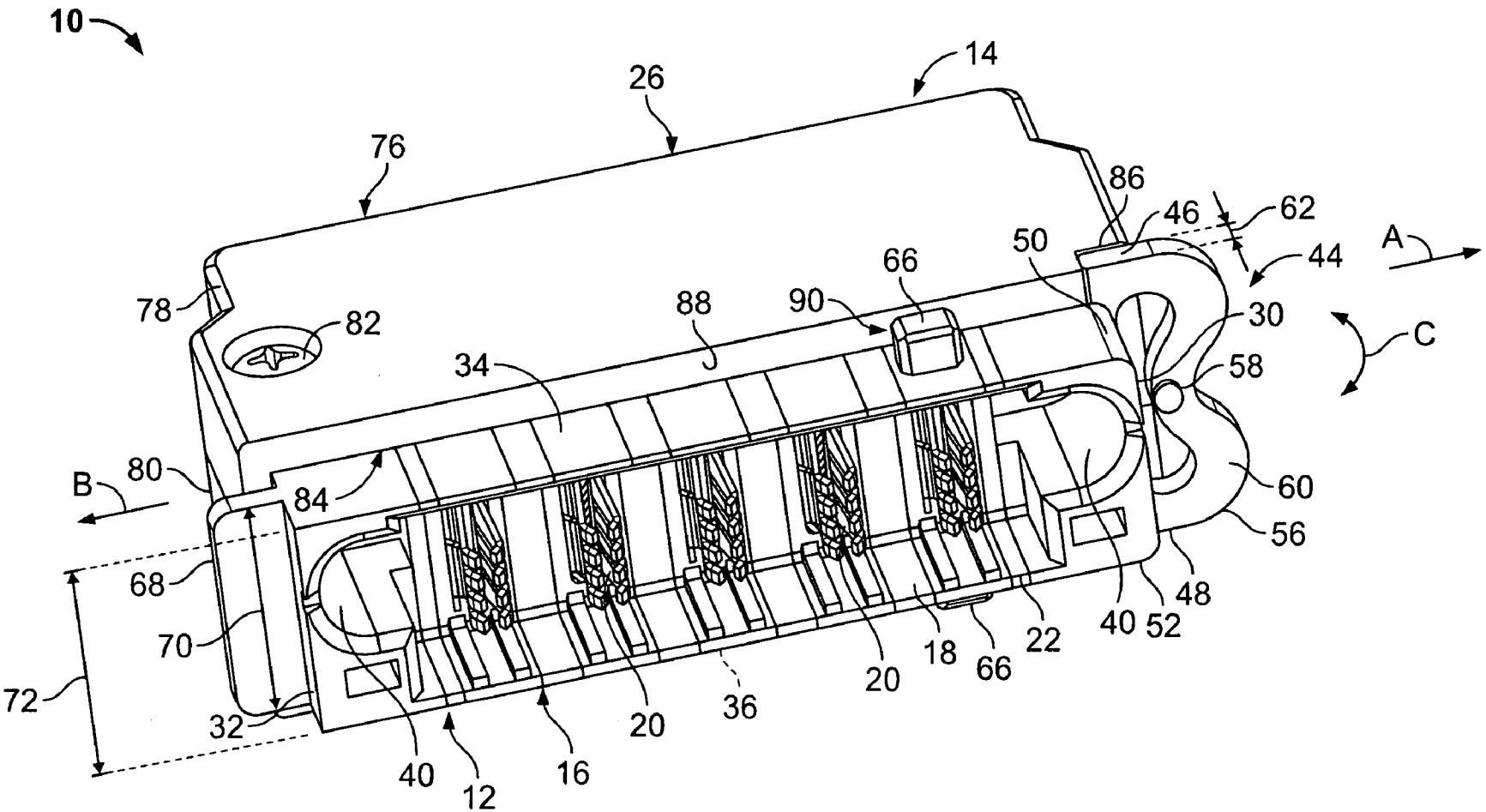
FIG. 1 is perspective view of a connector assembly formed in accordance with an exemplary embodiment of the present invention.

FIG. 1 is perspective view of a connector assembly 10 formed in accordance with an exemplary embodiment of the present invention. The assembly 10 includes a connector 12 and a backshell 14. In an exemplary embodiment, the connector 12 is a header or plug connector. In alternative embodiments, the connector 12 may be a receptacle connector as will be described. The connector 12 includes a connector housing 16 formed from a dielectric material. The connector housing 16 includes a forward mating end 18. A plurality of contacts 20 are surrounded by a shroud 22 at the forward mating end 18 of the connector housing 16. The contacts 20 are joined to a plurality of cables that extend from a cable exit end 26 of the backshell 14.

The connector housing 16 includes a first side 30, a second side 32 opposite the first side 30, a third side 34 and a fourth side 36 opposite the third side 34. Guidepost channels 40 extend from the forward mating end 18 rearwardly into the connector housing 16. The guidepost channels 40 are sized and configured to receive guideposts (not shown) from a mating connector (not shown) to position and align the connector 12 with the mating connector.

A latch member 44 extends from the first side 30 of the connector housing 16 in the direction of the arrow A. The latch member 44 includes a first end 46 and a second end 48 attached to first and second opposite ends 50 and 52, respectively, of the first side 30. The ends 46 and 48 of the latch member 44 are joined by an arcuate latch beam 56. A latch element 58 is positioned on a forward facing surface 60 of the latch beam 56. The arcuate shape of the latch beam 56 provides a latch beam 56 having an increased length that imparts sufficient flexibility to the latch beam 56. The increased flexibility of the latch beam 56 allows for an increased thickness 62 of the latch beam 56 to provide sufficient robustness for the latch member 44 to protect the latch member 44 from breakage without the need for protective devices such as shrouds to cover the latch member 44.

The connector housing 16 also includes locating lugs 66 that extend from third and fourth sides 34 and 36 of the housing 16. In one embodiment, the locating lugs 66 are substantially opposite each other. A retention tab 68 is formed on the second side 32 of the connector housing 16. The retention tab 68 extends from the second side 32 in the direction of the arrow B which is substantially opposite in direction of the arrow A. The retention tab 68 has a length 70 that is substantially equal to a length 72 of the second side 32. Thus, the retention tab 68 traverses the full length 72 of the second side 32.

The backshell 14 includes a backshell housing 76 that includes an upper portion 78 and a lower portion 80. The backshell upper and lower housing portions, 78 and 80 respectively, are held together by fasteners 82. In the embodiment shown in FIG. 1, one fastener 82 is visible in the upper backshell housing portion 78. A second fastener (not shown) joins the lower backshell housing portion 80 to the upper backshell housing portion 78 from an underside of the lower backshell housing portion 80. In one embodiment, the fasteners 82 are self tapping screws, although other fasteners may be utilized in other embodiments.

The backshell 14 has a forward facing connector receiving end 84 that receives the connector housing 16 and is opposite the cable exit end 26. Complementary keying and retention features (not shown) on the housing 16 and within the backshell housing 76 cooperate to locate and retain the connector housing 16 in the backshell housing 76. The backshell housing 76 includes a cutout portion 86 that receives the latch member 44 such that the forward facing surface 60 of the latch beam 56 is substantially co-planar with an edge 88 of the backshell housing 76 at the connector receiving end 84. In alternative embodiments, the latch member 44 may be located on the backshell 14. The connector 12 and backshell 14 are configured for mounting to a connector panel 100 (see FIG. 2). The locating lugs 66 are positioned sufficiently forward of the edge 88 to create a gap 90 between the locating lugs 66 and the edge 88 that is sized to receive a thickness of the connector panel 100. The latch member 44 flexes in the direction of the arrow C as the connector assembly 10 is mounted to the connector panel 100 as will be described.

Figure 2:
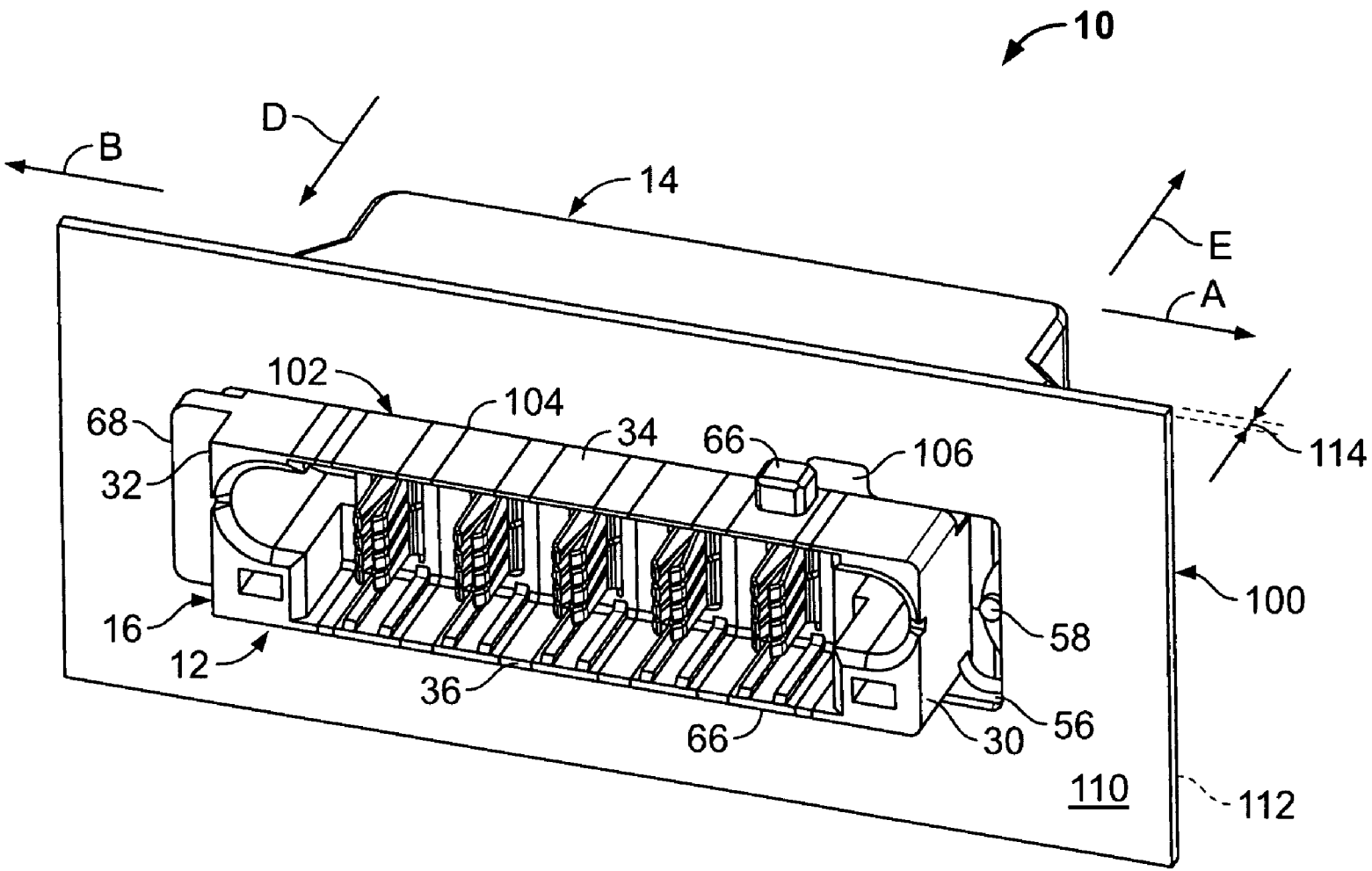
FIG. 2 is a perspective view of the connector assembly shown in FIG. 1 mounted in a connector panel.

FIG. 2 is a perspective view of the connector assembly 10 mounted in a connector panel 100. The connector panel 100 includes a panel opening 102 that has an inner edge 104 that extends about a perimeter of the panel opening 102. The panel opening 102 is configured to receive the connector 12. The panel opening 102 is sized such that, rather than an interference fit, clearance is provided between the connector 12 and the connector panel 100 to provide the connector 12 with some degree of float within the panel opening 102 to allow the connector 12 to center itself with a mating connector (not shown) in blind mating situations.

The connector panel 100 includes a pair of slots 106, only one of which is visible in FIG. 2, that extend from the edge 104 of the panel opening 102. The connector panel has a first or front side 110, an opposite second or rearward side 112, and a thickness 114 between the first and second sides 110 and 112, respectively. The connector assembly 10 is shown in a latched position in the connector panel 100.

In mounting the connector assembly 10, the connector housing 16 is inserted through the connector panel opening 102 from the second side 112 in the direction of the arrow D. Insertion is accomplished by aligning the locating lugs 66 with the slots 106. The locating lugs and the slots 106 are offset from a center position toward one of the first and second sides 30 and 32. In the arrangement shown, the slots 106 and locating lugs 66 are offset toward the first side 30. The assembly is advanced in a first direction, in the direction of the arrow D, until the edge 88 (FIG. 1) of the backshell and the latch beam 56 engage the second side 112 of the connector panel 100 which represents an insertion position wherein the retention tab 68 and the locating lugs 66 are positioned adjacent the first side 110 of the connector panel 100. The connector assembly 10 is then slid in a second direction substantially perpendicular to the first direction, that being in the direction of the arrow B, while pressure is applied against the second side 112 of the connector panel 100 which flexes the latch beam 56 in the direction of the arrow C (FIG. 1). When the connector assembly 10 has moved sufficiently in the direction of the arrow B, the latch element 58 snaps through the connector panel opening 102 and engages the inner edge 104 of the panel opening which corresponds to a latched position. In the latched position, the latch element 58 engages the inner edge 104 of the panel opening 102 to inhibit movement of the connector assembly 10 away from the latched position in the direction of the arrow A. In addition, the retention tab 68 and the locating lugs 66 engage the first side 110 of the connector panel 100 to inhibit extraction of the connector assembly 10.

Removal of the connector assembly 10 is accomplished by pushing inward on the latch element 58 in the direction of the arrow E until the latch element clears or passes the inner edge 104 of the panel opening 102 and sliding the connector assembly 10 in the direction of the arrow A until the insertion position is reached wherein the locating lugs 66 are aligned with the slots 106. The connector assembly 10 can then be withdrawn from the connector panel 100 in the direction of the arrow E.

Figure 3:
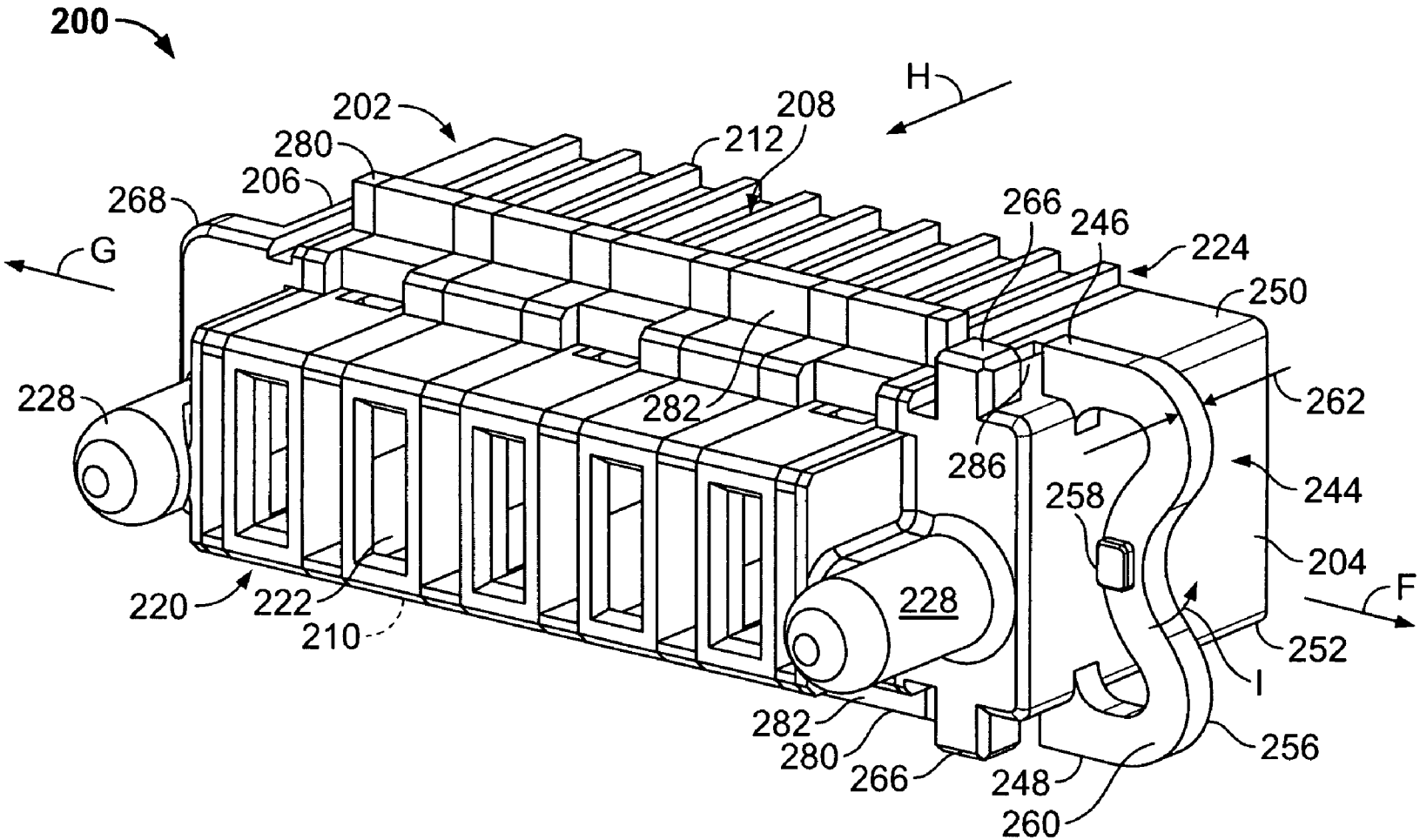
FIG. 3 is a perspective view of a receptacle connector formed in accordance with an embodiment of the present invention.

FIG. 3 is a rear perspective view of a receptacle connector 200 formed in accordance with an embodiment of the present invention. The receptacle connector 200 includes a receptacle housing 202 that has a first side 204, a second side 206 opposite the first side 204, a third side 208 and a fourth side 210 opposite the third side 208. In one embodiment, the third and fourth sides 208 and 210 each includes a plurality of ribs 212 distributed thereon. Other embodiments may or may not include the ribs 212. The receptacle housing 202 has a forward mating end 220 that includes a plurality of contact cavities 222 holding a plurality of contacts (not shown). The contact cavities 222 receive contacts from a mating header or plug connector (not shown). The contacts (not shown) are joined to a plurality of cables (not shown) that extend from a contact loading end 224 of the receptacle housing 202. In an exemplary embodiment, the receptacle connector 200 does not include a backshell and the contacts may be directly connected to cables at the contact loading end 224. Guideposts 228 extend forwardly from the forward mating end 220 of the receptacle housing 202. The guidepost 228 are configured to be received in guidepost channels, such as the channels 40 in the connector housing 16 (FIG. 1) in a mating connector (not shown). The guideposts 228 position and align the receptacle connector 200 with the mating connector.

A latch member 244 extends from the first side 204 of the receptacle housing 202 in the direction of the arrow F. The latch member 244 is similar to the latch member 44 (FIG. 1) previously described and includes a first end 246 and a second end 248 attached to first and second opposite ends 250 and 252, respectively, of the first side 204. The ends 246 and 248 of the latch member 244 are joined by an arcuate latch beam 256. A latch element 258 is positioned on a forward facing surface 260 of the latch beam 256. The arcuate shape of the latch beam 256 provides a latch beam 256 that has an increased length that imparts sufficient flexibility to the latch beam 256 to allow for an increased thickness 262 of the latch beam 256 to provide sufficient robustness for the latch member 244 to protect the latch member 244 from breakage without the need for protective devices such as shrouds.

The receptacle housing 202 also includes locating lugs 266 that extend from third and fourth sides 208 and 210 of the receptacle housing 16. In one embodiment, the locating lugs 266 are substantially opposite each other. In other embodiments, the locating lugs 266 may not be opposite each other. Rather, they may be located in any position that does not allow the receptacle connector 200 to be mounted on a connector panel, such as the panel 100 (FIG. 2) with inverted polarity. That is, the locating lugs 266 may be located in any position that provides for only one orientation of the receptacle connector 200 within the connector panel 100. A retention tab 268 is formed on the second side 206 of the receptacle housing 202. The retention tab 268 extends from the second side 206 in the direction of the arrow G which is substantially opposite in direction from the arrow F. The retention tab 268 has a length (not shown) that is substantially equal to a length (not shown) of the second 206. Thus, the retention tab 268 traverses the full length of the second side 206.

The receptacle housing 202 includes stop flanges 280 formed on the third and fourth sides 208 and 210, respectively, that engage the connector panel 100 (FIG. 2) to limit insertion of the receptacle connector 200 forwardly in the direction of the arrow H. Each stop flange 280 has a front face 282 that is substantially coplanar with the forward facing surface 260 of the latch beam 256. The locating lugs 266 are displaced forwardly from the stop flanges 280 and the latch beam 256 forming a gap 286 that is sized to receive the thickness 114 (FIG. 2) of the connector panel 100 (FIG. 2).

With reference to FIGS. 2 and 3, installation and removal of the receptacle connector 200 from the connector panel 100 is as described with regard to the connector assembly 10. The receptacle connector 200 is inserted through the connector panel opening 102 from the second side 112 in the direction of the arrow D. Insertion is accomplished by aligning the locating lugs 266 with the slots 106. The assembly is advanced in a first direction, in the direction of the arrow D, until the stop flange 280 and the latch beam 256 engage the second side 112 of the connector panel 100 which represents an insertion position wherein the retention tab 268 and the locating lugs 266 are positioned adjacent the first side 110 of the connector panel 100. The receptacle connector 200 is then slid in the second direction substantially perpendicular to the first direction, that being in the direction of the arrow B, while pressure is applied against the second side 112 of the connector panel 100 which flexes the latch beam 256 in the direction of the arrow I (FIG. 3). When the receptacle connector 200 has moved sufficiently in the direction of the arrow B, the latch element 258 snaps through the connector panel opening 102 and engages the inner edge 104 of the panel opening 102 which corresponds to a latched position. In the latched position, the latch element 258 engages the inner edge 104 of the panel opening 102 to inhibit movement of the receptacle connector 200 away from the latched position in the direction of the arrow A. In addition, the retention tab 268 and the locating lugs 266 engage the first side 110 of the connector panel 100 to inhibit extraction of the receptacle connector 200.

Removal of the receptacle connector 200 is accomplished by pushing inward on the latch element 258 in the direction of the arrow E until the latch element clears or passes the inner edge 104 of the panel opening 102 and then sliding the receptacle connector 200 in the direction of the arrow A until the insertion position is reached wherein the locating lugs 266 are aligned with the slots 106. The receptacle connector 200 can then be withdrawn from the connector panel 100 in the direction of the arrow E.

The embodiments thus described provide a connector assembly 10 and a receptacle connector 200 that save space on a connector panel and are mountable without tools. The connector assembly 10 and receptacle connector 200 include latch members 44, 244 that latch the connector assembly 10 and a receptacle connector 200 in a latched position on the connector panel 100. The latch members 44, 244 include arcuate latch beams 56, 256 that are sufficiently flexible due to their overall lengths that they can be fabricated with an increased thickness to add robustness to the latch members 44, 244 to protect the latch members 44, 244 against breakage without the need for protective devices such as shrouds.

While the invention has been described in terms of various specific embodiments, those skilled in the art will recognize that the invention can be practiced with modification within the spirit and scope of the claims.

What is claimed is:

1. An electrical connector for mounting to a panel, the connector comprising:

a connector housing having a forward mating end and a rearward contact loading end, said housing including a first side and a second side opposite said first side, and said housing configured for insertion into an opening in the panel, the opening having an inner edge, and wherein said housing is inserted into the panel opening in a first direction in an insertion position and is movable within the panel opening in a second direction substantially perpendicular to said first direction from said insertion position to a latched position; and a latch member extending from said first side of said housing in a direction opposite said second direction, said latch member having first and second ends attached at respective first and second opposite ends of said first side of said housing, an arcuate latch beam joining said first and second ends of said latch member, and a latch element positioned in a middle portion of the arcuate latch beam and located on a forward facing surface of said latch beam, wherein said latch element engages the inner edge of the panel opening when said housing is in said latched position to hold said housing in said latched position;

wherein the middle portion arcuately bent toward the connector housing.

2. The connector of claim 1, further comprising a backshell including a connector receiving end and a cable exit end, said connector housing coupled to said connector receiving end of said backshell, said backshell having an edge at said connector receiving end that engages the panel to limit movement of said housing in said first direction, and wherein said latch member is, located on one of said housing and said backshell.

3. The connector of claim 1, further comprising a backshell including a connector receiving end and a cable exit end, said connector housing coupled to said connector receiving end of said backshell, wherein said backshell includes a cutout at said connector receiving end that receives said latch member.

4. The connector of claim 1, wherein a portion of said forward facing surface of said latch beam engages the panel to limit movement of said connector m said first direction.

5. The connector of claim 1, wherein said housing includes a locating lug formed on a third side of said housing, said locating lug configured to be received in a locating slot in the panel when said housing is in said insertion position, said locating lug engaging the forward side of the panel to inhibit extraction of said housing from the panel when the housing is in said latched position.

6. The connector of claim 1, wherein said housing includes a locating lug formed on a third side of said housing, said locating lug configured to be received in a locating slot in the panel, and wherein said locating lug is placed in an offset position toward one of said first and second sides to orient the connector within the panel.

7. The connector of claim 1, wherein said housing includes one of a cylindrical guidepost and a cylindrical guidepost channel each if which is configured to couple with the other of a guidepost or guidepost channel on a mating connector.

8. The connector of claim 1, wherein said housing includes a flange formed on a third side of said housing, said flange, wherein said flange engages the panel to limit movement of said housing in said first direction.

9. The connector of claim 1, wherein said housing includes a flange and a locating lug, both formed on a third side of said housing, wherein said locating lug is displaced forwardly from said flange to define a gap sized to receive a thickness of the panel.

10. The connector of claim 1, further comprising a backshell including a connector receiving end and a cable exit end, said connector housing coupled to said connector receiving end of said backshell, said backshell having an edge at said connector receiving end, said housing including a locating lug, both formed on a third side of said housing, and wherein said locating lug is displaced forwardly from said edge of said backshell to define a gap sized to receive a thickness of the panel.

11. An electrical connector for mounting to a panel, the connector comprising:

a connector housing having a forward mating end and a rearward contact loading end, said housing including a first side and a second side opposite said first side, and said housing configured for insertion in an opening in a panel, the opening having an inner edge, and wherein said housing is inserted in the panel opening in a first direction in an insertion position and is movable within the panel opening in a second direction substantially perpendicular to said first direction from said insertion position to a latched position;

a latch member extending from said first side of said housing in a direction opposite said second direction, said latch member having first and second ends attached at respective first and second opposite ends of said first side of said housing, an arcuate latch beam joining said first and second ends of said latch member, and a latch element positioned in a middle portion of the arcuate latch beam and located on a forward facing surface of said latch beam, wherein said latch element engages the inner edge of the panel opening when said housing is in said latched position to hold said housing in said latched position;

wherein the middle portions arcuately bent toward the connector housing; and a retention tab formed on a second side of said housing opposite said first side, said retention tab having a length substantially equal to a length of said second side, and wherein said retention tab extends from said housing in said second direction, said retention tab engaging a forward side of the panel to inhibit extraction of said housing from the panel when the housing is in said latched position.

12. The connector of claim 11, further comprising a backshell including a connector receiving end and a cable exit end, said connector housing coupled to said connector receiving end of said backshell, said backshell having an edge at said connector receiving end that engages the panel to limit movement of said housing in said first direction, and wherein said latch member is located on one of said housing and said backshell.

13. The connector of claim 11, further comprising a backshell including a connector receiving end and a cable exit end, said connector housing coupled to said connector receiving end of said backshell, wherein said backshell includes a cutout at said connector receiving end that receives said latch member.

14. The connector of claim 11, wherein a portion of said forward facing surface engages the panel to limit movement of said connector in said first direction.

15. The connector of claim 11, wherein said housing includes a locating lug formed on a third side of said housing, said locating lug configured to be received in a locating slot in the panel when said housing is in said insertion position, said locating lug engaging the forward side of the panel to inhibit extraction of said housing from the panel when the housing is in said latched position.

16. The connector of claim 11, wherein said housing includes a locating lug formed on a third side of said housing, said locating lug configured to be received in a locating slot in the panel, and wherein said locating lug is placed in an offset position toward one of said first and second sides to orient the connector within the panel.

17. The connector of claim 11, wherein said housing includes one of a cylindrical guidepost and a cylindrical guidepost channel each of which is configured to couple with the other of a guidepost or guidepost channel on a mating connector.

18. The connector of claim 11, wherein said housing includes a flange formed on a third side of said housing, wherein said flange engages the panel to limit movement of said housing in said first direction.

19. The connector of claim 11, wherein said housing includes a flange and a locating lug, both formed on a third side of said housing, wherein said locating lug is displaced forwardly from said flange to define a gap sized to receive a thickness of the panel.

20. The connector of claim 11, further comprising a backshell including a connector receiving end and a cable exit end, said connector housing coupled to said connector receiving end of said backshell, said backshell having an edge at said connector receiving end, said housing including a locating lug, both formed on a third side of said housing, and wherein said locating lug is displaced forwardly from said edge of said backshell to define a gap sized to receive a thickness of the panel.

* * * * *